US005085285A

United States Patent [19]

Elsby et al.

[11] Patent Number: 5,085,285

[45] Date of Patent: Feb. 4, 1992

[54] COMPENSATING RING FOR A DOWN HOLE HAMMER

[75] Inventors: John Elsby, Leeming; John U. Dewar, South Guildford; Andrew Greathead, Woodvale; Brian T. Sanfead, Connolly, all of Australia

[73] Assignee: D.T.A. Pty. Ltd., Bayswater, Australia

[21] Appl. No.: 553,337

[22] Filed: Jul. 17, 1990

[51] Int. Cl.[5] ..... E21B 10/36; E21B 17/10

[52] U.S. Cl. ..... 175/325; 175/409; 175/418

[58] Field of Search ..... 175/293, 294, 295, 325, 175/320, 415, 417, 418, 409

[56] References Cited

U.S. PATENT DOCUMENTS

| | | | |
|---|---|---|---|
| 2,022,101 | 11/1935 | Wright | 175/293 |
| 3,667,817 | 6/1972 | Kellner | 175/325 |
| 3,923,324 | 12/1975 | Cruickshank et al. | 175/325 X |
| 4,108,257 | 8/1978 | Sizer | 175/325 X |
| 4,706,764 | 11/1987 | Hughes | 175/320 |

*Primary Examiner*—Stephen J. Novosad
*Attorney, Agent, or Firm*—John S. Hale

[57] ABSTRACT

The present invention relates to a sacrificial compensating ring for a down hole hammer having an outer sleeve, a drive sub and a drill bit, wherein the sacrificial compensating ring has an outer diameter greater than that of the outer sleeve and substantially the same as that of the drill bit and the sacrificial compensating ring being located between the outer sleeve and the drive sub.

6 Claims, 2 Drawing Sheets

COMPENSATING RING FOR A DOWN HOLE HAMMER

Figure 1:
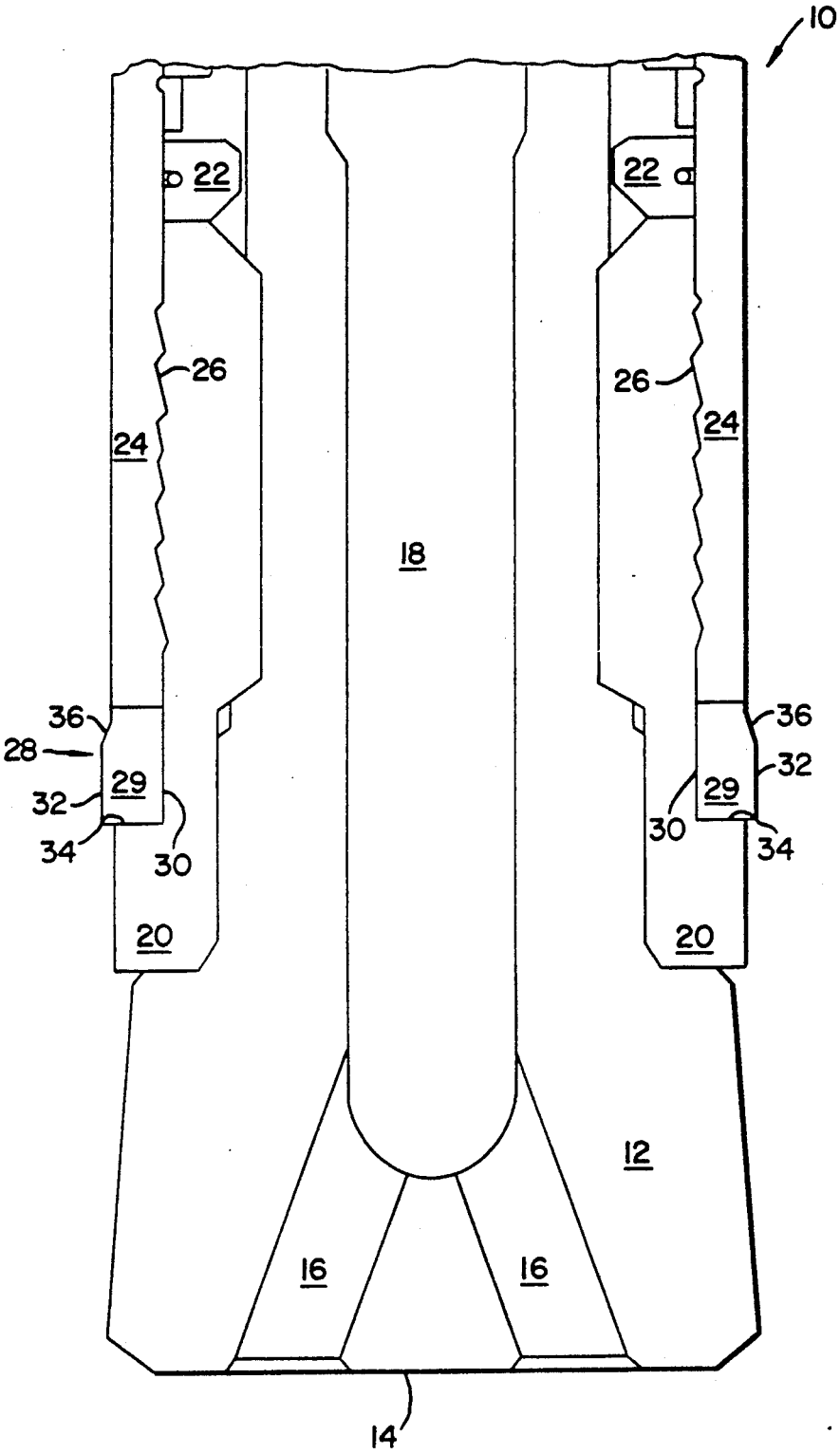

The present invention relates to a sacrificial compensating ring for a down hole hammer.

In general, in the art of reverse circulation drilling, a relatively small annular clearance typically about 3 mm is provided between the drill tube and the bore of the hole being drilled. The clearance must be kept relatively small so that air preferentially travels around the drill bit over the cutting face and up inside the drill bit and not through the annular clearance. Some leakage of air through the clearance is inevitable but is intended to be kept small.

As the cutting face bores the hole, it becomes blunt and wears. The drill bit must then be removed from the hole and the cutting face of the bit ground to make the cutting face sharp. As a result, the drill bit becomes smaller in diameter. When the bit diameter is very close to that of the drill tube, the bit is no longer serviceable and must be discarded. Otherwise the drill tube may become damaged through contact with the wall of the hole.

The drill tube is relatively expensive and the drill bits are comparatively expensive and this leads to two conflicting requirements.

On one hand the clearance between the drill tube and the bore must be kept as small as is practical to minimise leakage and maximise sample recovery. This means the drill bit must be very close in diameter to the drill tube, but not so close so as to lead to damage of the drill tube. Thus, the usable bit life is reduced. On the other hand, to increase bit life means the clearance between the drill tube and the bore must be as large as is practical to enable the drill bit to be reground more times and so used for longer. Thus, the drill bit must be larger in diameter compared to the drill tube. Consequently, more air is able to leak through the annular clearance and the sample recovery rate drops. This is because much more of the sample is blown out of the hole around the drill tube and the volume of compressed air carrying the sample up inside the drill tube is reduced.

Prior art devices have attempted to overcome this trade off by blowing air downwardly in the annular clearance adjacent the drill bit. This has only been partially successful and results in increased air consumption and sample contamination.

The present invention provides a sacrificial compensating ring for a down hole hammer that attempts to overcome the above stated problems.

The sacrificial compensating ring of the present invention is designed to provide an effective seal between the bore of the hole and the drill tube and to wear down at a similar rate as the drill bit to maintain such seal as the drill bit wears. The seal created by the use of the compensating ring allows an acceptable sample recovery rate to be maintained without sample contamination or increased air consumption. The sacrificial compensating ring allows use of larger drill bits than would otherwise be the case for a given diameter drill tube.

Sacrificial in the context of the present invention means that the compensating ring is intended to be consumed in drilling much the same as the drill bit is.

In accordance with one aspect of the present invention there is provided a sacrificial compensating ring for a down hole hammer having an outer sleeve, a drive sub held in the outer sleeve and a drill bit retained in the drive sub, the sacrificial compensating ring comprising a first inner surface and a second outer surface, the diameter of the second outer surface being greater than that of the outer sleeve and substantially the same as that of the drill bit, the compensating ring being shaped for location between the outer sleeve and the drive sub such that they are longitudinally spaced apart.

In accordance with another aspect of the present invention there is provided a down hole hammer comprising a drill bit retained in a drive sub, the drive sub being held in an outer sleeve and a sacrificial compensating ring in accordance with the present invention located longitudinally intermediate the outer sleeve and the drive sub, the sacrificial compensating ring comprising a first inner surface substantially conforming to the drive sub and a second outer surface, the diameter of the second outer surface being greater than that of the outer sleeve and substantially the same as that of the drill bit.

Figure 2:
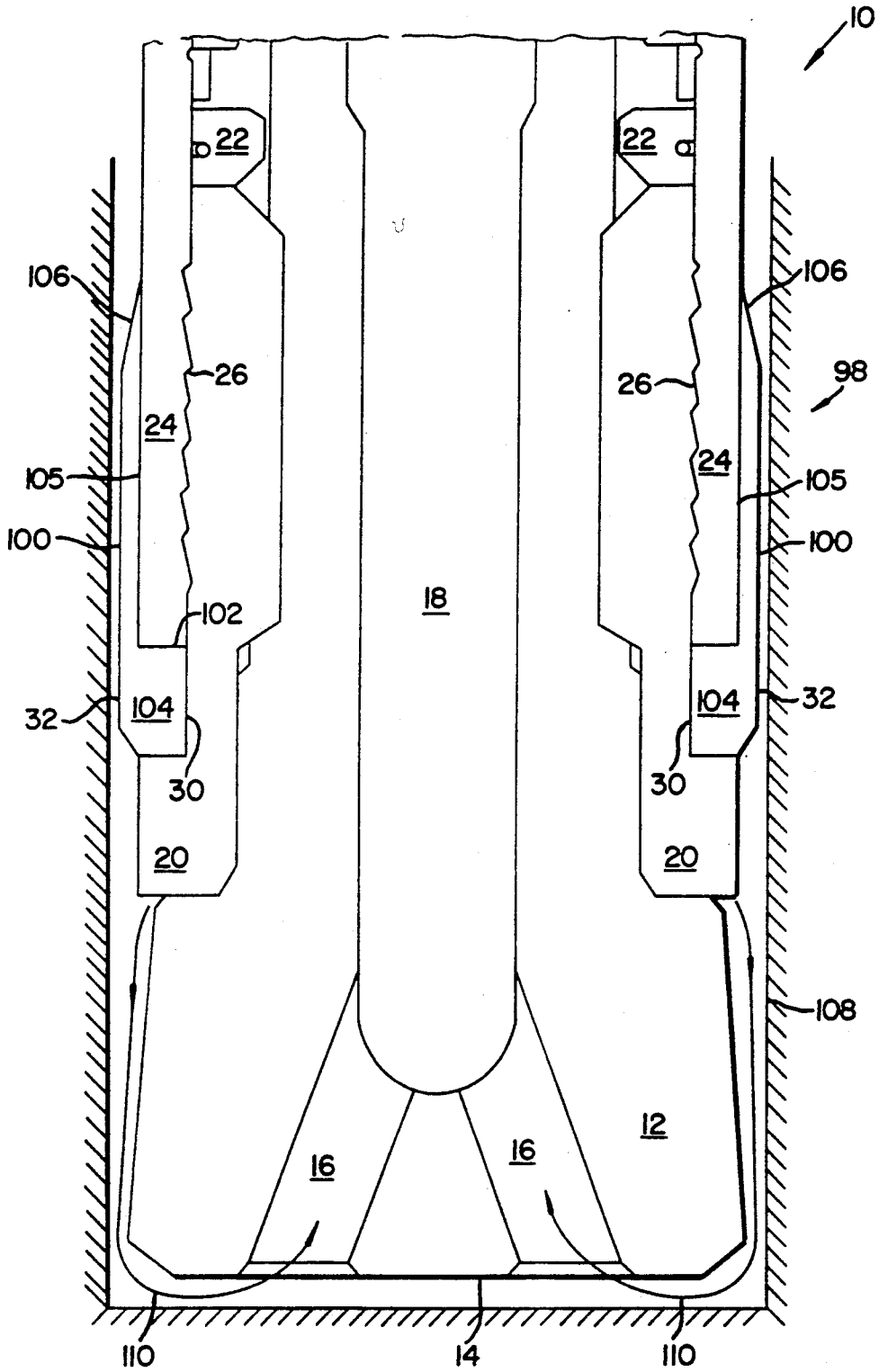

The present invention will now be described, by way of example, with reference to the accompanying drawings, in which:

FIG. 1 is a sectional side view of a down hole hammer incorporating a sacrificial compensating ring in accordance with the present invention; and FIG. 2 is a sectional side view of the down hole hammer of FIG. 1 incorporating a sacrificial compensating ring in accordance with another embodiment of the present invention.

Shown in the drawings is a reverse circulation down hole hammer 10 comprising a drill bit 12 having a cutting face 14 and a plurality of apertures 16 extending into a central aperture 18. The drill bit 12 is retained in a drive sub 20 by slip split rings 22 in known manner. The drive sub 20 is held in an outer sleeve 24 typically by way of a threaded portion 26 of the outer sleeve 24.

The outer sleeve 24 surrounds porting means (not shown) of known type to enable a piston (not shown) to reciprocally strike the bit 12 in known manner.

Longitudinally intermediate of the outer sleeve 24 and the drive sub 20 is a sacrificial compensating ring 28 having a body 29 comprising a first inner surface 30 substantially conforming to the drive sub 20 and a second outer surface 32.

The body 29 comprises a base 34 extending transversely to a longitudinal axis of the down hole hammer 10 and a bevel 36 inclined to a longitudinal axis of the down hole hammer 10 (and hence to the axis of the compensating ring 28).

Typically, such inclination is of the order of 15°. As shown the bevel 36 tapers inwardly to be flush with the outer sleeve 24. As may also be seen, the body 29 is partially protuberant of the outer sleeve 24, typically by about 3 mm to 16 mm, where the drill bit 12 is between about 46 and 160 mm in diameter, and the drill tube is about 140 mm in diameter, for example. It is to be noted that most drilling equipment is measured in imperial means and the range of drill bit 12 sizes is between 5.75 to 6.25 inch diameter for a 5.5 inch diameter drill tube. Preferably, the diameter of the compensating ring 28, as measured at the second outer surface 32, is substantially the same as that of the drill bit 12.

In FIG. 2 there is shown a second embodiment of a sacrificial compensating ring 98 in accordance with the present invention. The compensating ring 98 is similar to the compensating ring 28 and like numerals denote like parts.

The compensating ring 98 further comprises an annular body 100 extending from a circumferential edge 102 of a body 104 of the compensating ring 98. The flange 100 is disposed with an interior surface 105 overlying the outer sleeve 24 and directed away from the drill bit 12.

The flange 100 preferably has a diameter substantially the same as that of the second outer surface 32. The flange 100 typically has no mechanical interference or location with the outer sleeve 24 of the hammer 10. That is, the flange 100 typically is not threaded onto the outer sleeve 24.

The bevel 36 of the outer surface 32 is replaced with a bevel 106 located at a free end of the flange 100. The bevel 106 is otherwise of identical formation and purpose as the bevel 36 in the first mentioned embodiment.

The body 29, 104 is typically about 25 mm long measured in the longitudinal direction of the down hole hammer 10. The flange 100 is typically about 90 mm long measured in the longitudinal direction of the down hole hammer 10 starting at the edge 102 of the base 104. All being dimensions consistent with drill bit diameter of between 146 mm to 160 mm—which is typically for 5.75, 6.00 and 6.25 inch drill bits 12.

Typically, the compensating ring 28, 98 has initially an outside diameter about 3 mm smaller (0.125 inches) than the diameter of the drill bit 12 so as to avoid drag otherwise caused by the compensating ring 28, 98, at the outset of drilling.

Typically, the compensating ring 28 is used for sealing to smaller holes 108 (i.e. 146 mm, 5.75 inch) and the compensating ring 98 is used for sealing to larger holes 108 (i.e. 152 or 160 mm, 6.00 or 6.25 inch).

Typically, the compensating ring 28, 98 is made of a heat treated alloy steel with a hardness similar to the outer sleeve 24 but softer than the drive sub 20. The wear characteristics of the compensating ring 28, 98 are preferably similar to those of the drill bit 12.

In use, the compensating ring 28, 98 is placed on the drive sub 20 and the drive sub 20 is tightly threaded onto the threaded portion 26 of the outer sleeve 24. In the case of the compensating ring 98, the flange 100 is disposed so that its inner surface 105 overlies and contacts the outer sleeve 24 adjacent the drive sub 20. In both cases the bevel 36, 106 is uppermost and provides a taper to the outer sleeve 24.

The down hole hammer 10 with the compensating ring 28, 98 fitted is then drilled, drill bit 12 first, to form a hole 108 (FIG. 2) or inserted, drill bit 12 first, into the hole 108. The down hole hammer 10 is operated in known manner and the cutting face 14 produces rock chips.

Compressed air passes out of the down hole hammer 10, in a manner known in the art and shown by arrows 110, and carries the rock chips through the apertures 16, into the central aperture 18 and thence to be recovered.

The body 29 of the compensating ring 28, and the flange 100 and body 104 of the compensating ring 98, both being of substantially of the same diameter as that of the drill bit 12, are close to or in contact with the bore of the hole 108 and thus present a substantially positive barrier or seal to the leakage of air. Rock chips carried by air thus tend not to pass this barrier or seal and thus are unlikely to contact the outer sleeve 24. This is particularly true of shallow holes 108 and of relatively soft ground. Hence wear of the outer sleeve 24 is reduced.

The outer sleeve 24 surrounds porting means for the hammer 10 and is very expensive compared to the drill bit. A larger annular clearance between the outer sleeve 24 and the bore of the hole 108 is able to be used as a result of this substantially positive barrier and so the outer sleeve 24 is better protected from wear. The drill bit 12 is able to be reground more times, thereby increasing bit life. The incidence of wearing of the drive sub 20 is also reduced.

As is known, the bit 12 decreases in diameter after being reground. The compensating ring 28, 98 is now of larger diameter than the bit 12 but will wear to a diameter substantially the same as that of the bit 12.

Alternatively, the compensating ring 28, 98 may also be reground to substantially the same diameter as the bit 12. The inclined bevel 36, 106 directs rock chips away from the sleeve 24 when the down hole hammer 10 is removed from the hole 108 and thereby reduces the likelihood of catching or jamming of the down hole hammer 10 in the hole 108.

Typically, the compensating ring 28, 98 is not threaded or otherwise fixed onto the drive sub 20 or the outer casing 24 (in the case of the latter). This is because difficulties in tightening and loosening of the drive sub 20 compensating ring 28, 98 and outer sleeve 24 could occur if it was so fixed.

The present invention enables a larger drill bit to be used while still maintaining an acceptable barrier or seal against air leakage between the outer sleeve 24 and the hole 108. Bit life is increased and wear of the outer sleeve 24 and the drive sub 20 is decreased. Also a greater return of sample chips via the central aperture 18 is achieved.

Also, for the compensating ring 98, the flange 100 extends over substantially all of the threaded portion 26 between the drive sub 20 and the outer sleeve 24 and so it deters operators from placing hydraulic break out tools, such as hydraulic stilsens, upon the threaded portion 26. Accordingly, the incidence of compressing the thread is reduced and hence break out is made easier.

Further, the flange 100 also protects the outer sleeve 24 adjacent the drive sub 20 and hence extends its life.

The compensation ring 28, 98 of the present invention is a relatively inexpensive, relatively short life, sacrificial element to protect and prolong the life of the down hole hammer 10 adjacent the drill bit 12 and achieves good sealing between the hole and the drive sub 20 to attain better collection of chippings and less contamination thereof and reduces loss of chippings between the down hole hammer 10 and the hole 108.

Modifications and variations such as would be apparent to a skilled addressee are deemed within the scope of the present invention. For example, it could be used for larger down hole hammers 10.

We claim:

1. A reverse circulation down hole hammer comprising an outer sleeve, a drive sub held in the outer sleeve, a drill bit retained in the drive sub, and a sacrificial compensating ring, said sacrificial compensating ring comprising a first inner surface and a second outer surface, the diameter of the second outer surface being greater than that of the outer sleeve and substantially the same as that of the drill bit, the sacrificial compensating ring being located between the outer sleeve and the drive sub such that they are longitudinally spaced apart and said outer surface is partially protuberant of said outer sleeve.

2. A reverse circulation down hole hammer according to claim 1, in which the sacrificial compensating ring is made from a heat treated alloy steel with a hardness similar to that of the outer sleeve but less than that of the drive sub.

3. A reverse circulation down hole hammer according to claim 1, in which the sacrificial compensating ring has wear characteristics similar to the drill bit so that each will wear at a similar rate when in use.

4. A reverse circulation down hole hammer according to claim 1, in which the sacrificial compensating ring further comprises a body about which the first inner surface and second outer surface exist, the outer surface of the body being provided with a bevel inclined to a longitudinal axis of the compensating ring and tapered inwardly towards the outer sleeve so as to meet with the outer sleeve so as to meet with the outer sleeve remote from the drill bit.

5. A reverse circulation down hole hammer according to claim 1 in which the sacrificial compensating ring further comprises a body about which the first inner surface and second outer surface are positioned and an annular flange extending from said body, said annular flange overlying and being in contact with said outer sleeve.

6. A reverse circulation down hole hammer according to claim 5, in which said annular flange incorporates a bevel remote from the base inclined to a longitudinal axis of the compensating ring and tapered inwardly towards the outer sleeve so as to meet with the outer sleeve remote from the drill bit.

* * * * *